United States Patent [19]

Turetsky

[11] Patent Number: 4,848,799

[45] Date of Patent: Jul. 18, 1989

[54] RIBBON BOOKMARK

[76] Inventor: Isadore Turetsky, 3328 Shipmate Dr., Las Vegas, Nev. 89117

[21] Appl. No.: 192,163

[22] Filed: May 9, 1988

[51] Int. Cl.[4] ..... B42D 9/00; B42D 15/00; B05D 5/10; B44L 1/10

[52] U.S. Cl. ..... 281/42; 283/101; 427/208; 156/240

[58] Field of Search ..... 281/42, 43; 283/37, 283/39, 81, 94, 98, 101, 106; 156/235, 239, 234, 240; 116/237, 238, 239; 427/208

[56] References Cited

U.S. PATENT DOCUMENTS

| | | | |
|---|---|---|---|
| 2,394,372 | 2/1946 | Evans | 281/42 |
| 3,138,476 | 6/1964 | Phipps | 427/208 |
| 3,556,894 | 10/1967 | Bernard | 156/235 |
| 3,664,910 | 5/1972 | Hollie | 283/101 |
| 4,159,586 | 7/1979 | Blum | 283/101 |
| 4,248,919 | 2/1981 | Davis | 283/101 |
| 4,517,044 | 5/1985 | Arnold | 156/240 |
| 4,574,727 | 3/1986 | Martin | 281/42 |

FOREIGN PATENT DOCUMENTS

| | | | |
|---|---|---|---|
| 211119 | 11/1940 | Switzerland | 281/42 |

*Primary Examiner*—Douglas D. Watts
*Assistant Examiner*—Paul M. Heyrana, Sr.

[57] ABSTRACT

A ribbon bookmark which is to be joined to a book by adhesive means and optionally disposed intermediate the tape across the backbone of the signatures and the spine of said book, or on the exposed surface of said spine. Means are provided to facilitate installation of said ribbon bookmark.

5 Claims, 3 Drawing Sheets

RIBBON BOOKMARK

FIELD OF THE INVENTION

This invention relates to ribbon bookmarks which are used in relatively expensive books, and which are now sewn with the signatures during the binding of said book.

An object of the invention is to provide a ribbon bookmark which can be joined to a book by adhesive means and which can be optionally disposed intermediate the tape across the backbone of the signatures and the spine of said book, or on the exposed surface of the spine of the book.

Another object of the invention is to provide simple, novel, and economic means for installing said ribbon bookmark before, or especially after covers are attached to said book.

Embodiments of the invention capable of accomplishing the foregoing objects and providing the advantages contemplated by them are described in the following specification which may be readily understood by reference to the accompanying drawings.

DETAILED DESCRIPTION OF THE DRAWINGS

Figure 1:
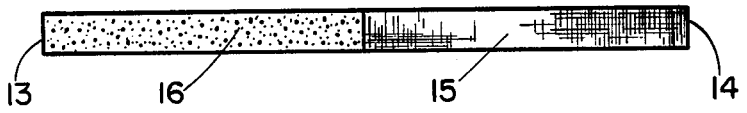
FIG. 1 is a front elevational view of a ribbon, a portion of said ribbon coated on one side with suitable adhesive.

Referring to the detailed drawings, FIG. 1 illustrates a ribbon bookmark 15 having one surface of its lower section coated with a suitable adhesive 16 the ribbon being preferably but not necessarily made of woven fibers. The upper end 14 nd lower end 13 are noted for later explanatory purpose.

Figure 2:
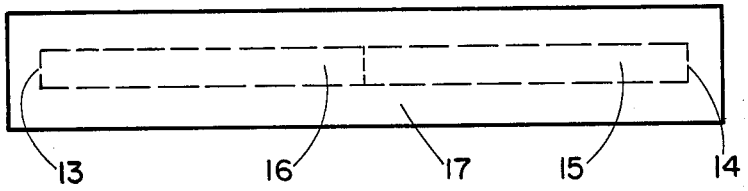
FIG. 2 is a front elevational view of the ribbon shown in FIG. 1 with a separable cover tape joined to the adhesive surface of said ribbon.

FIG. 2 illustrates the ribbon bookmark 15 as shown in FIG. 1 covered by a separable tape 17, the tape being preferably but not necessarily of synthetic plastic material. Polyethylene tape has been used with very good results.

Figure 3:
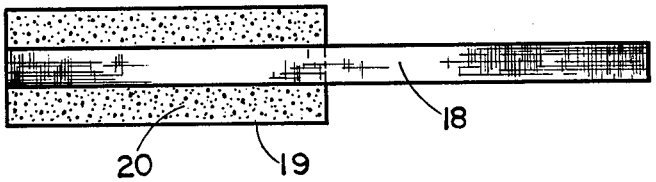
FIG. 3 illustrates a front elevational view of a ribbon bookmark joined to tape which is coated on one surface with a suitable adhesive.

FIG. 3 illustrates a ribbon bookmark 18 joined to tape 19 by adhesive means; one surface of the tape 19 being coated with a suitable adhesive 20. The tape can be preferably but not necessarily of fibrous material.

Figure 4:
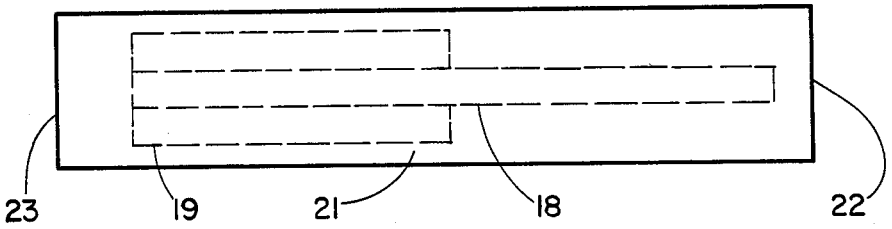
FIG. 4 illustrates the elements shown in FIG. 3 with a separable cover tape adherend the tape shown in said FIG. 3.

FIG. 4 illustrates the assembly shown in FIG. 3 covered by separable cover tape 21 the top and bottom ends 22 and 23 respectively of cover tape 21 extend beyond the respective ends of said covered assembly. The separable cover tape 21 can be preferably but not necessarily of synthetic plastic material.

Figure 5:
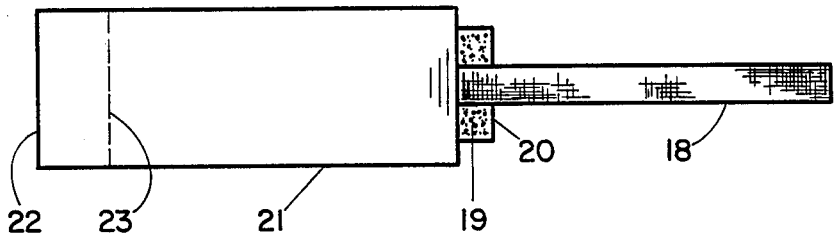
FIG. 5 illustrates the elements shown in FIG. 4 with the upper end section of the cover tape folded down.

FIG. 5 illustrates the assembly shown in FIG. 4 with the upper section of the cover tape 21 folded forward and down thereby exposing a portion of tape 19 with its adhesive coating 20. The end 22 of the folded section of separable cover tape 21 extends below end 23 of said cover tape 21.

Figure 6:
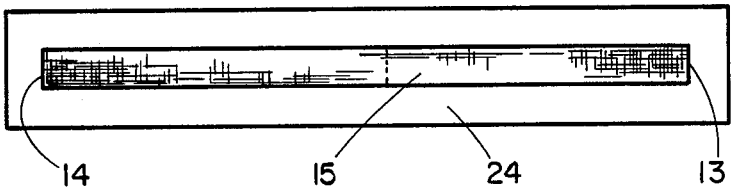
FIG. 6 illustrates a front elevational view of the ribbon bookmark shown in FIG. 1 which is adhesively joined to a separable flexible cover strip.

FIG. 6 illustrates the ribbon 15 shown in FIG. 1 which has been rotated 180 degrees about its horizontal axis, and joined by means of its adhesive coated surface to a preferably but not necessarily flexible strip cover 24 which is separable, and which can be plastic, metal or wood.

Figure 7:
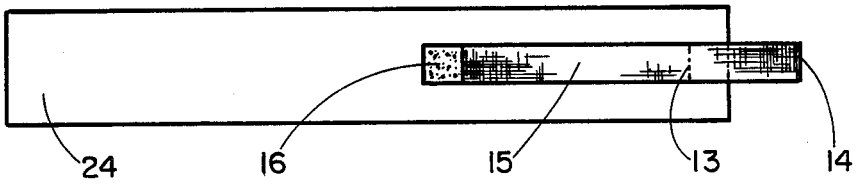
FIG. 7 illustrates the elements shown in FIG. 6 with the lower section of the ribbon bookmark folded up.

FIG. 7 illustrates the assembly shown in FIG. 6 with the lower end section of ribbon 15 folded up, so that end 14 of the ribbon extends above the end 13 of said ribbon, and exposes a portion of the ribbon which is coated with adhesive 16.

Figure 8:
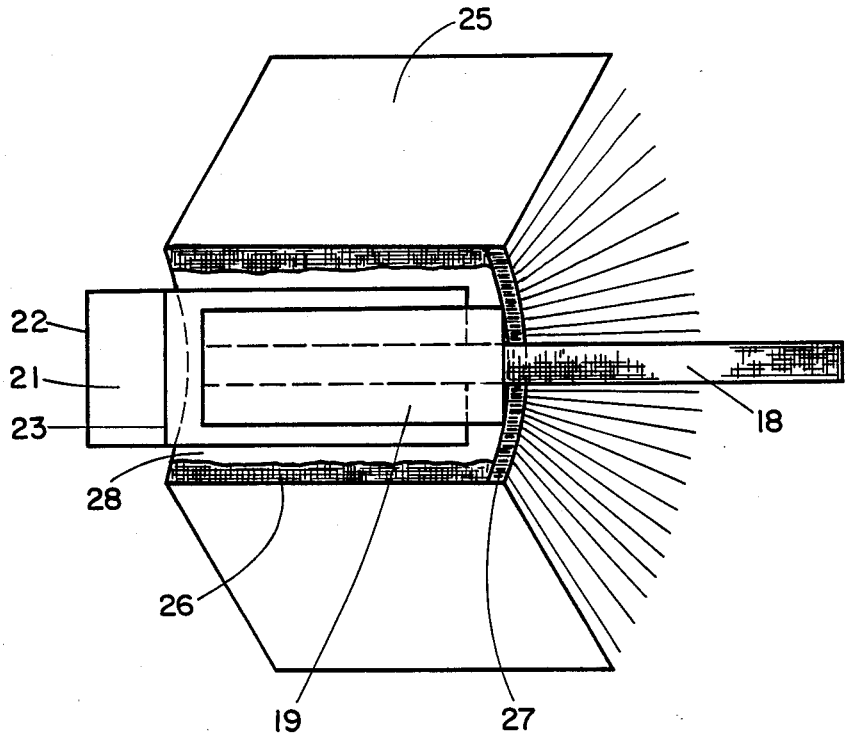
FIG. 8 illustrates a front elevational view of an open book with its spine removed for clarity, and shows the assembly illustrated in FIG. 5 in position for installing the ribbon bookmark.

FIG. 8 illustrates a book 25 which is open and from which the spine has been removed for clarity. Shown is a portion of woven tape 26 which is bonded to the signatures backbone 27 of said book. Also shown is a portion of a paper tape 28 which is fixed to said woven tape 26. Many books are bound in this fashion. Some books may not have woven tape. Instead the paper tape can be fixed directly to the backbone of the signatures. Shown in position intermediate the spine (not shown) and said woven tape 26 is the assembly shown in FIG. 5 which has been rotated 180 degrees about its vertical axis, so that the adhesive coated surface of tape 19 faces paper tape 28 to which said tape 19 is to be adhesively joined. To insert the ribbon and tape assembly as shown the book is partially or fully opened to form a sufficiently large space between the book spine and said signatures backbone 27. The book can then be held in a vertical position so that the ribbon and tape assembly can be inserted into said space. The ribbon and tape assembly is positioned to expose the end 22 of cover tape 21 sufficiently beyond the lower end of book 25. The other end 23 of cover tape 21 can extend past the lower end of backbone 27. With the ribbon and tape assembly in position as shown the book 25 can be closed or partially closed. Before closing the book pressure can be applied by manual means across that portion of the tape 19 having the exposed adhesive coating 20 thereby facilitating placement of the ribbon 18. With the book closed or partially closed the ribbon 18 can be held in one hand, and the exposed section of tape 21 with end 22 pulled with the other hand, thereby peeling cover tape 21 from the adhesive coatd tape 19. The entire adhesive coated surface of tape 19 can then be firmly joined to tape 28 by applying manual pressure across the spine. The ribbon 15 with separable cover 17 as shown in FIG. 2 can be joined to the book by similar means.

Figure 9:
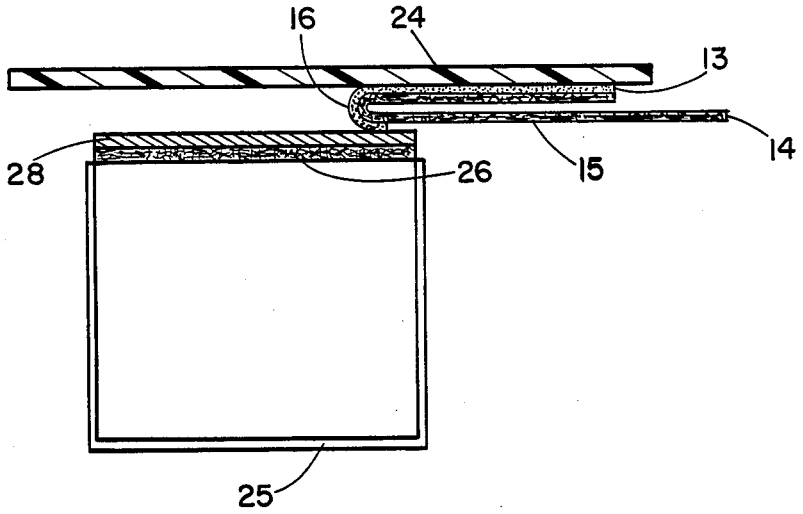
FIG. 9 illustrates a side elevation sectional view of the assembly shown in FIG. 7, and a book from which the front cover and the spine have been removed; the ribbon bookmark positioned for installation.

FIG. 9 illustrates a side elevation sectional view of the assembly shown in FIG. 7. Also shown in an elevation sectional view of tapes 26 and 28 of book 25 which is closed. The front cover, the spine, and some pages of the book have been removed for clarity. The flexible cover strip 24 with its attached ribbon 15 are shown disposed intermediate woven tape 26, paper tape 28, and the spine (not shown) of the book prior to installation of ribbon bookmark 15. To install the assembled ribbon 15 with flexible cover strip 24 of preferably but not necessarily plastic material the book is opened thereby enlarging the space intermediate tape 28 and the spine (not shown) permitting insertion into said space of said ribbon and strip assembly. With said assembly in position as shown the book 25 can be closed or partially closed. The loose end of ribbon 15 can be held by one hand, or held firmly between pages of the closed book. The exposed lower end of cover strip 24 can then be pulled to progressively peel, insert, and invert the remaining adhesive coated portion of ribbon 15 so that the entire coat of adhesive faces tape 28. With the cover strip 24 separated the adhesive coated surface of ribbon 15 can then be firmly joined to tape 28 by pplying manual pressure across the spine. One skilled in the art will note that the ribbon 18 and tape 19 assembly shown in FIG. 3 can be similarly installed with the use of cover strip 24. Also, by rearranging the assembly shown in FIG. 5 so that cover tape 21 is substituted for cover strip 24, the ribbon can be similarly installed.

Though the bookmarks illustrated in FIG. 1 and FIG. 3 can be joined to the exposed side of the spine of a soft cover, pocket, or hard cover book they are particularly adapted for installation intermediate the spine and tape across the backbone of the signatures of a common hard cover book using means hereinbefore described. The ribbon can, if desired, be joined to the inside surface of the spine. One skilled in the art will also note that although the illustrated ribbon bookmarks can be installed in a completely assembled hard cover book they can be joined before the covers are attached, so that the bookmark will be disposed intermediate the tape across the signatures backbone and the spine of said book.

In the chosen embodiments of my invention exemplified by the accompanying drawings there are features not hereinbefore disclosed, and changes that may be made in form and configuration of the parts without departing from the scope of the claims that follow.

I claim:

1. A ribbon bookmark which is to be secured to a book and disposed intermediate the tape across the backbone of the signatures and spine of said book, said bookmark comprising:

a ribbon marker, a tape which is coated on one surface with a suitable adhesive, one end section of said ribbon affixed adjacent to a portion of said surface by means of said adhesive, the ribbon marker extended for placement between pages of the book;

a separable cover adhesively joined to that portion of said adhesive coated surface which is not in direct contact with said ribbon end section, said cover extended for a sufficient length so that when disposed intermediate said backbone and spine of the book an end of said cover extends beyone said book;

to facilitate positioning the ribbon between said backbone and spine by adhesive means, a relatively small area of said adhesive covered surface, at the end section of said tape nearest the extended ribbon, is exposed prior to inserting said tape between said backbone and spine of said book;

the cover is seprated after said tape is disposed between the backbone and spine of said book, the cover being separated by grasping said cover end and peeling the cover from the adhesive coated surface of said tape while said extended ribbon is held firmly, for purposes of adhesively affixing said tape to said book.

2. The invention defined in claim 1 in which said cover is sufficiently extended so that when folded and disposed between the backbone and spine of said book an end of said folded cover extends beyond the book.

3. The invention defined in claim 1 in which that portion of said tape having a covered adhesive surface is disposed in an inverted position prior to separation of said cover, said portion being progressively inverted again during separation of said cover.

4. The invention defined in claim 1 in which said separable cover is a flexible plastic strip.

5. The invention defined in claim 1 in which a surface of said ribbon end section is coated with a suitable adhesive and joined directly to said separable cover by means of said adhesive, thereby eliminating the use of said adhesive coated tape.

* * * * *